US009344794B1

(12) United States Patent
Blonder

(10) Patent No.: US 9,344,794 B1
(45) Date of Patent: May 17, 2016

(54) MULTI MODE HEADPHONE WITH FOLDING HEADBAND

(71) Applicant: Greg E. Blonder, Summit, NJ (US)

(72) Inventor: Greg E. Blonder, Summit, NJ (US)

(73) Assignee: IdeaVillage Products Corp., Wayne, NJ (US)

( * ) Notice: Subject to any disclaimer, the term of this patent is extended or adjusted under 35 U.S.C. 154(b) by 0 days.

(21) Appl. No.: 14/544,231

(22) Filed: Dec. 11, 2014

Related U.S. Application Data

(63) Continuation-in-part of application No. 13/815,538, filed on Mar. 8, 2013.

(60) Provisional application No. 61/914,738, filed on Dec. 11, 2013.

(51) Int. Cl.
*H04R 1/10* (2006.01)

(52) U.S. Cl.
CPC ..... *H04R 1/1091* (2013.01); *H04R 2201/025* (2013.01)

(58) Field of Classification Search
CPC .... H04R 1/10; H04R 2205/022; H04R 1/105; H04R 5/0335; H04R 2201/10
USPC ..... 381/370, 374, 378–379, 383–384
See application file for complete search history.

(56) References Cited

U.S. PATENT DOCUMENTS

| | | | | | |
|---|---|---|---|---|---|
| 1,087,704 | A * | 2/1914 | Randall | H04R 5/0335 | 381/378 |
| 1,133,833 | A * | 3/1915 | Randall | H04R 5/0335 | 381/374 |
| 1,603,431 | A * | 10/1926 | Wacker | H04R 1/1008 | 381/378 |
| 4,409,442 | A * | 10/1983 | Kamimura | H04R 5/0335 | 381/370 |
| 4,597,469 | A * | 7/1986 | Nagashima | H04R 5/0335 | 381/383 |
| 6,993,143 | B2 * | 1/2006 | Harris | H04R 5/0335 | 381/374 |

* cited by examiner

*Primary Examiner* — Suhan Ni
(74) *Attorney, Agent, or Firm* — Dan DeLaRosa

(57) ABSTRACT

A music playing and listening apparatus comprising a headband having opposing ends, and having at least one hinge; at least two connectors, each of the connectors having at least two arms, a first arm being shorter than a second arm, the first and second arm forms an axis; and at least two speakers, each of the speakers having opposing sides and comprising an audio output element on a first side and a compartment on a second side, the first and second arms of each of the connectors being pivotally attached to a portion of each of the speakers to thereby allow rotation of the speakers about the axis, each of the audio output elements of each of the speakers generally face one another during a first music listening mode, each of the speakers being rotatable about the first and second arms of each of the connectors to thereby allow each of the audio output elements of each of the speakers to turn away from one another during a second music playing mode; the rotation of the speakers allowing for changes in modes; the hinge of the headband allows the headband to open a wider distance between the speakers in the second music playing mode.

19 Claims, 12 Drawing Sheets

MULTI MODE HEADPHONE WITH FOLDING HEADBAND

RELATED APPLICATIONS

This is a utility application related to and claims priority to provisional application No. 61/914,738 filed on Dec. 11, 2013, which is hereby incorporated by reference in its entirety and a continuation-in-part of pending U.S. application with Ser. No. 13/815,538 filed on Mar. 8, 2013, which is hereby incorporated by reference in its entirety.

TECHNICAL FIELD

Embodiments of the present disclosure relate to the field of audio devices and, more particularly, to a headphone or headset including an adjustable headband for transitioning the headphone into a flattened position.

BACKGROUND

Certain audio headphones are capable of conversion between a speaker configuration and a headphone configuration by twisting each speaker housing around an axle by up to 180 degrees. For example, U.S. patent application Ser. No. 13/815,538 filed on Mar. 8, 2013, the entirety of which is hereby incorporated by reference herein, disclose a headphone including an amplifier within at least one speaker housing which is activated by twisting or turning the speaker housing into a particular position.

The rotation of the speakers triggers an integrated amplifier to adjust the sound levels produced by the headphone (or headset) as appropriate for either of the speaker mode (wherein the headphone operates as two external speakers) and/or the headphone mode (wherein the headphone operates as a conventional headphone wearable on the ears of the user).

SUMMARY OF THE INVENTION

In one embodiment, music playing and listening apparatus comprising a headband having opposing ends, and having at least one hinge; at least two connectors, each of the connectors having at least two arms, a first arm being shorter than a second arm, the first and second arm forms an axis; and at least two speakers, each of the speakers having opposing sides and comprising an audio output element on a first side and a compartment on a second side, the first and second arms of each of the connectors being pivotally attached to a portion of each of the speakers to thereby allow rotation of the speakers about the axis, each of the audio output elements of each of the speakers generally face one another during a first music listening mode, each of the speakers being rotatable about the first and second arms of each of the connectors to thereby allow each of the audio output elements of each of the speakers to turn away from one another during a second music playing mode; the rotation of the speakers allowing for changes in modes; the hinge of the headband allows the headband to open a wider distance between the speakers in the second music playing mode.

In another embodiment the hinge is centrally located on said headband.

In a further embodiment, there are two hinges on said headband equally spaced apart from the opposing ends of the headband.

In yet another embodiment, the axis of rotation has an angle from about 30 degrees to about 60 degrees relative to a plane of the headphone.

In still another embodiment, each of the speakers is designed to rotate about the axis during the first music listening mode at angles from about 0 degrees to about 180 degrees.

In still yet another embodiment, the headband is generally situated over a user's head and each of said audio output elements of each of said speakers generally faces the user's ears during said first music listening mode.

In another embodiment, the apparatus is set on a surface and the speakers are designed to be rotated about the first and second arms of each of the connectors to allow the audio output elements of each of the speakers to generally face away from the surface during the second music playing mode.

In a further embodiment, a safety interlocking device which is designed to limit the volume output of the speakers in the first listening mode and increases the volume output of the speakers during the second music playing mode.

In yet another embodiment, at least one amplifier, the amplifier is connected to a portion of at least one of the speakers.

In still yet another embodiment, at least one switching mechanism, the switching mechanism is activated by rotating each of the speakers from the music listening mode to the second music playing mode, the rotation of the speakers activates the amplifier.

In a further embodiment, at least one switching mechanism, the switching mechanism is activated by rotating one of the speakers from the music playing mode to the second music listening mode, the rotation of one of the speakers deactivates the amplifier.

In yet a further embodiment, at least one of the compartments of the speakers provides for storage of a power source. In still another embodiment, at least one power source, the power source is a battery.

In yet another embodiment, the apparatus comprises an on and off mechanism. In still another embodiment, the apparatus comprises a volume control mechanism, the volume control mechanism controls audio output volume of the speakers.

In still another embodiment, the apparatus comprises a cable.

In yet another embodiment, a music playing and listening apparatus comprising:

a headband having opposing ends, said headband having at least one resilient section; at least two connectors, each of the connectors having at least two arms, a first arm being shorter than a second arm, the first and the second arms form an axis; and at least two speakers, each of the speakers having opposing sides and comprising an audio output element on a first side and a compartment on a second side, the first and second arms of each of the connectors being pivotally attached to a portion of each of the speakers to thereby allow rotation of the speakers about the axis, each of the audio output elements of each of the speakers generally face one another during a first music listening mode, each of the speakers being rotatable about the first and second arms of each of the connectors to thereby allow each of the audio output elements of each of the speakers to turn away from one another during a second music playing mode; the rotation of the speakers allowing for changes in modes; the resilient section allows the headband to open flat in the second music playing mode.

In still another embodiment, the central resilient section is configured to be flexible in a first condition and rigid in a second condition.

In yet a further embodiment, a music playing and listening apparatus comprising: a headband having opposing ends, the headband having at least one pivoting section; at least two connectors, each of the connectors having at least two arms, a first arm being shorter than a second arm, the first and the second arm form an axis; and at least two speakers, each of the speakers having opposing sides and comprising an audio output element on a first side and a compartment on a second side, said first and second arms of each of the connectors being pivotally attached to a portion of each of the speakers to thereby allow rotation of the speakers about the axis, each of the audio output elements of each of the speakers generally face one another during a first music listening mode, each of the speakers being rotatable about the first and second arms of each of the connectors to thereby allow each of the audio output elements of each of the speakers to turn away from one another during a second music playing mode; the rotation of the speakers allowing for changes in modes; the pivoting section allows the headband to fold open in the second music playing mode.

BRIEF DESCRIPTION OF THE DRAWINGS

The accompanying drawings are included to provide a further understanding of the present invention. These drawings are incorporated in and constitute a part of this specification, illustrate one or more embodiments of the present invention and together with the description, serve to explain the principles of the present invention.

Among those benefits and improvements that have been disclosed, other objects and advantages of this invention will become apparent from the following description taken in conjunction with the accompanying drawings. The drawings constitute a part of this specification and include exemplary embodiments of the present invention and illustrate various objects and features thereof.

DETAILED DESCRIPTION OF THE INVENTION

As required, detailed embodiments of the present invention are disclosed herein; however, it is to be understood that the disclosed embodiments are merely exemplary of the invention that may be embodied in various forms. The figures are not necessarily to scale, some features may be exaggerated to show details of particular components. Therefore, specific structural and functional details disclosed herein are not to be interpreted as limiting, but merely as a basis for the claims and as a representative basis for teaching one skilled in the art to variously employ the present invention.

The present disclosure relates to a headphone including a headband configured for transition into a flattened position. In an implementation, in the flattened position, wherein a left speaker and a right speaker are extended away from one another to increase the stereo separation of the headphone in a speaker mode.

Figure 1:
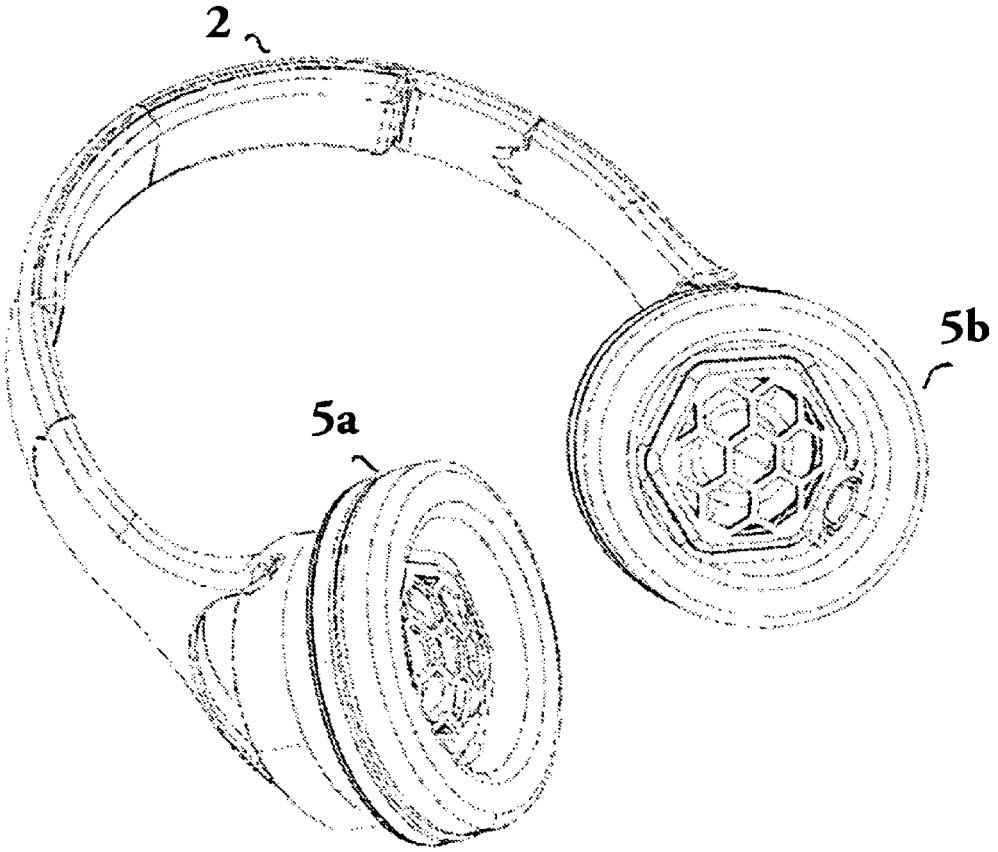
FIG. 1 is a perspective view of the apparatus of the present invention in a speaker mode.

FIG. 1 illustrates the configuration of a headband 2 connecting a left speaker 5*a* and right speaker 5*b* limits the position of the left speaker 5*a* and the right speaker 5*b* when the headphone is in the speaker mode. In this regard, while the headphone in FIG. 1 is appropriate for wearing around a user's neck or laid on a surface, the two speakers are position close to one another, thus providing little stereo separation.

Figure 2:
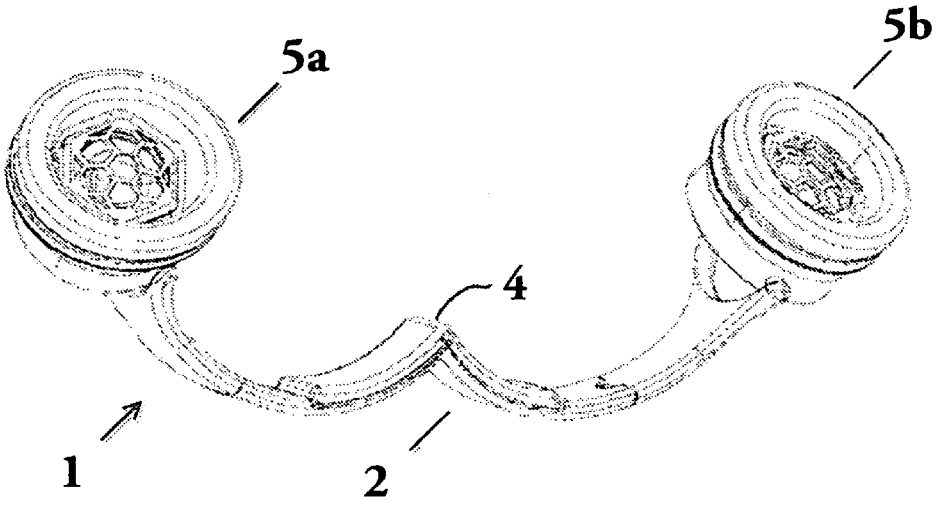
FIG. 2 is a perspective view of the apparatus of the present invention including a headband having a hinge arranged at or near a center of the headband.

FIG. 2 illustrates an embodiment of a headphone 1 including a headband 2 having a hinge 4 arranged at or near a center of the headband 2. In an embodiment, the hinge 4 enables the headphone 1 to be placed in a flattened position as shown in FIG. 2. In the flattened position, a left speaker 5*a* and right speaker 5*b* are extended away from one another. It is noted that the hinge 4 may be arranged in any suitable position to enable the extension of the headband 2 and separation of a left speaker 5*a* and a right speaker 5*b*. It is further noted that in addition to a hinge 204, alterternative mechanical arrangements may be employed in order to allow the headband 203 to transition between the flattened or extended position and a non-extended position (e.g., the position in FIG. 3).

Figure 3:
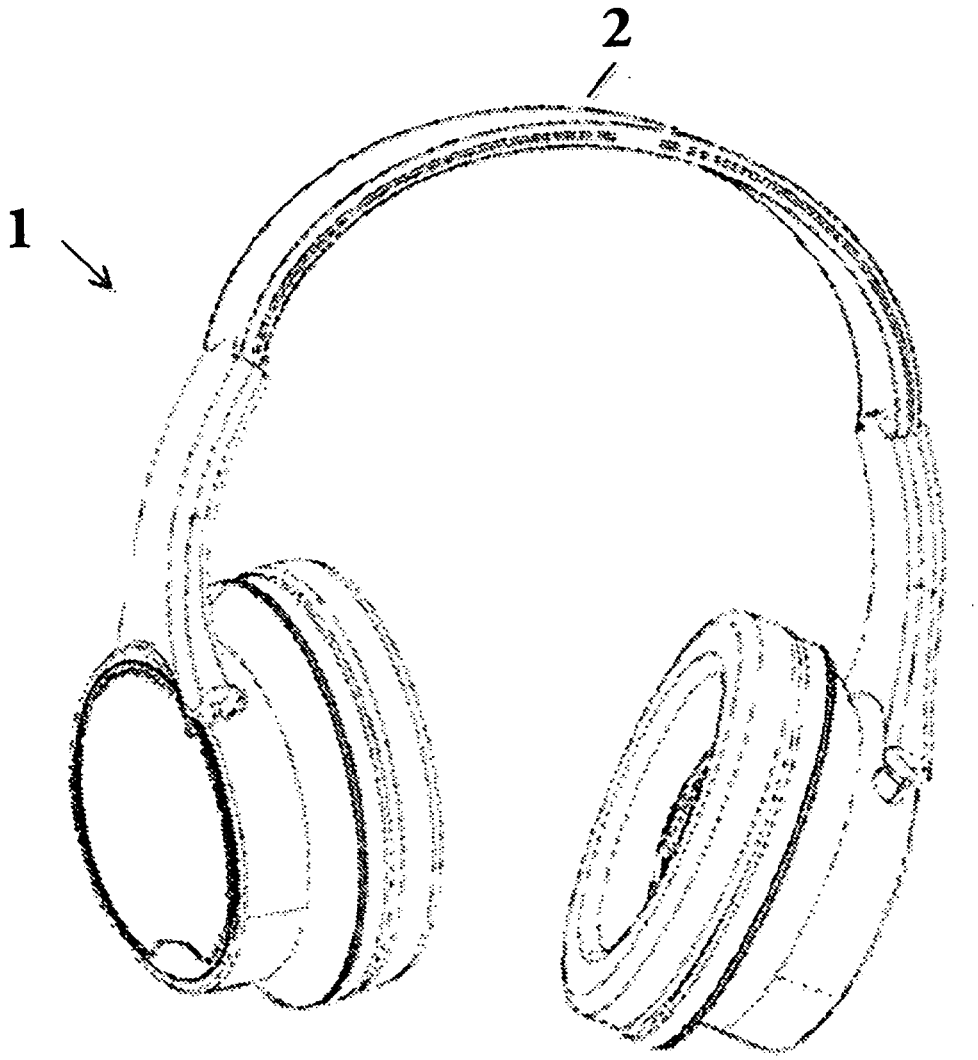
FIG. 3 is a perspective view of the apparatus of the present invention in a music listening mode.
Figure 4:
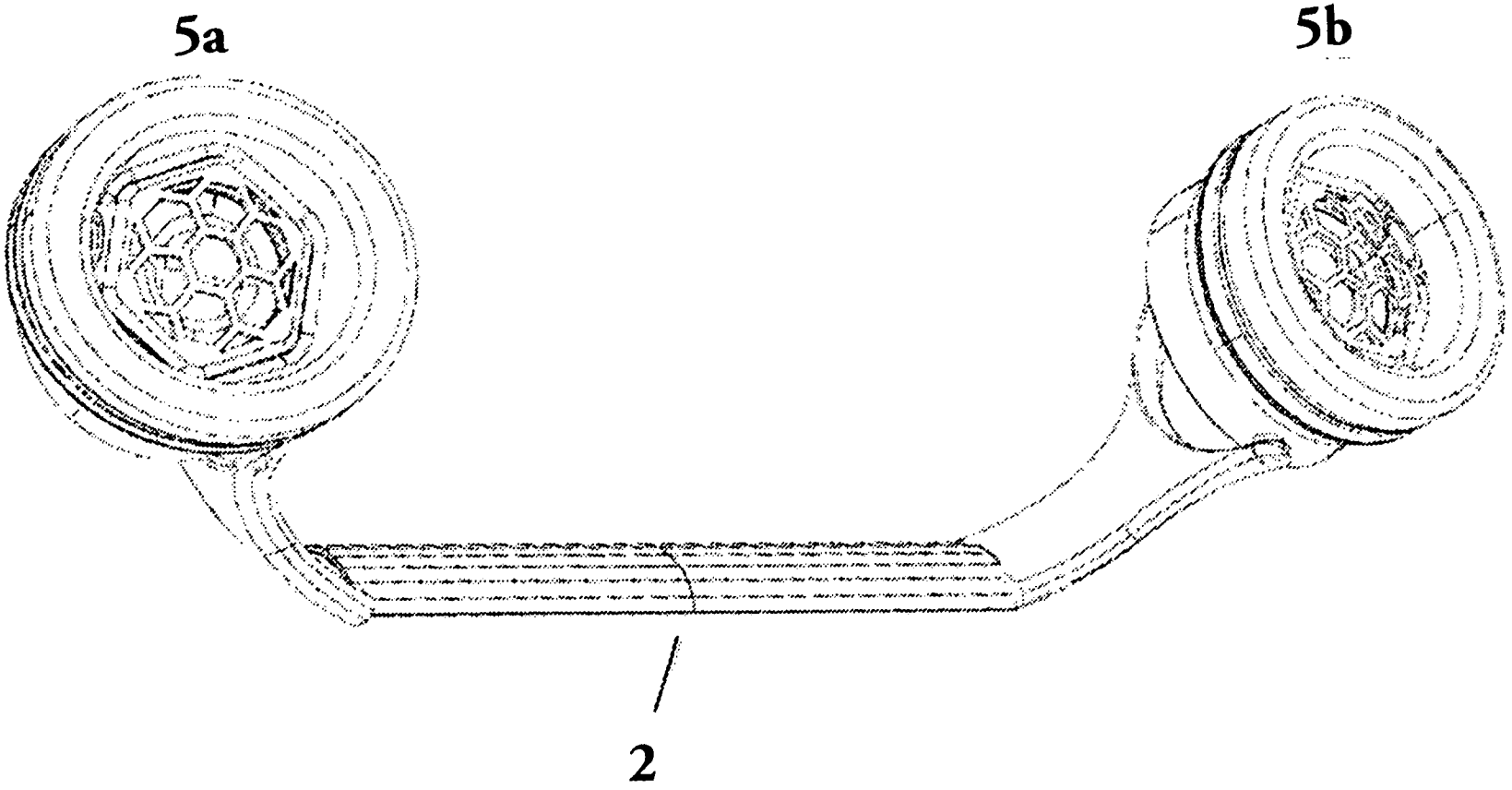
FIG. 4 is a perspective view of the apparatus of the present invention said headband opened flat in said second music playing mode.

In another embodiment, the headphone is a convertible headphone capable of converting from a wearable headphone (as shown in FIG. 3) to an extended position including externally facing and amplifying speakers (as shown in FIGS. 2 and 4). In a further embodiment, the headphone includes an amplifier within at least one speaker housing which is activated by twisting or turning the speaker housing into a particular position (e.g., the extendable headphone may be placed in "speaker mode" by twisting the headphone enclosures away from the ears to convert the headphones into an externally-directed amplified speaker). U.S. application Ser. No. 13/815,538, filed on Mar. 8, 2013, and U.S. patent application Ser. No. 14/053,799, filed on Oct. 15, 2013, the entirety of both are hereby incorporated by reference herein, disclose an embodiment of a convertible headphone, according to embodiments of the present disclosure.

FIG. 3 illustrates an exemplary implementation wherein a headband 2 is configured in a collapsible arrangement, such as a curved "slap bracelet" or comprised of a coiled tape measure's metal foil. In an embodiment, the headphone is comprised of metal strips (e.g., 3-10 mils thick) and covered with a soft cushion for comfort. In another embodiment, curved foils are employed with bi-stable, configurable into a first shape/position wherein the foils of headband 2 are curved (e.g., as shown in FIG. 3) and/or a second shape/position wherein the foils of headband 2 are flattened (e.g., as shown in FIG. 4).

In yet another embodiment, speakers 5*a* and 5*b* may be detachable from the headband 2. In this embodiment, the speakers 5*a* and 5*b* can be detached from the headband 2 for greater stereo separation. In this embodiment, the speakers 5*a*, 5*b* may be wired together via a Y-yoke audio cable or cord, or communicated via a wireless communicator, such as a wireless Bluetooth device.

Figure 5:
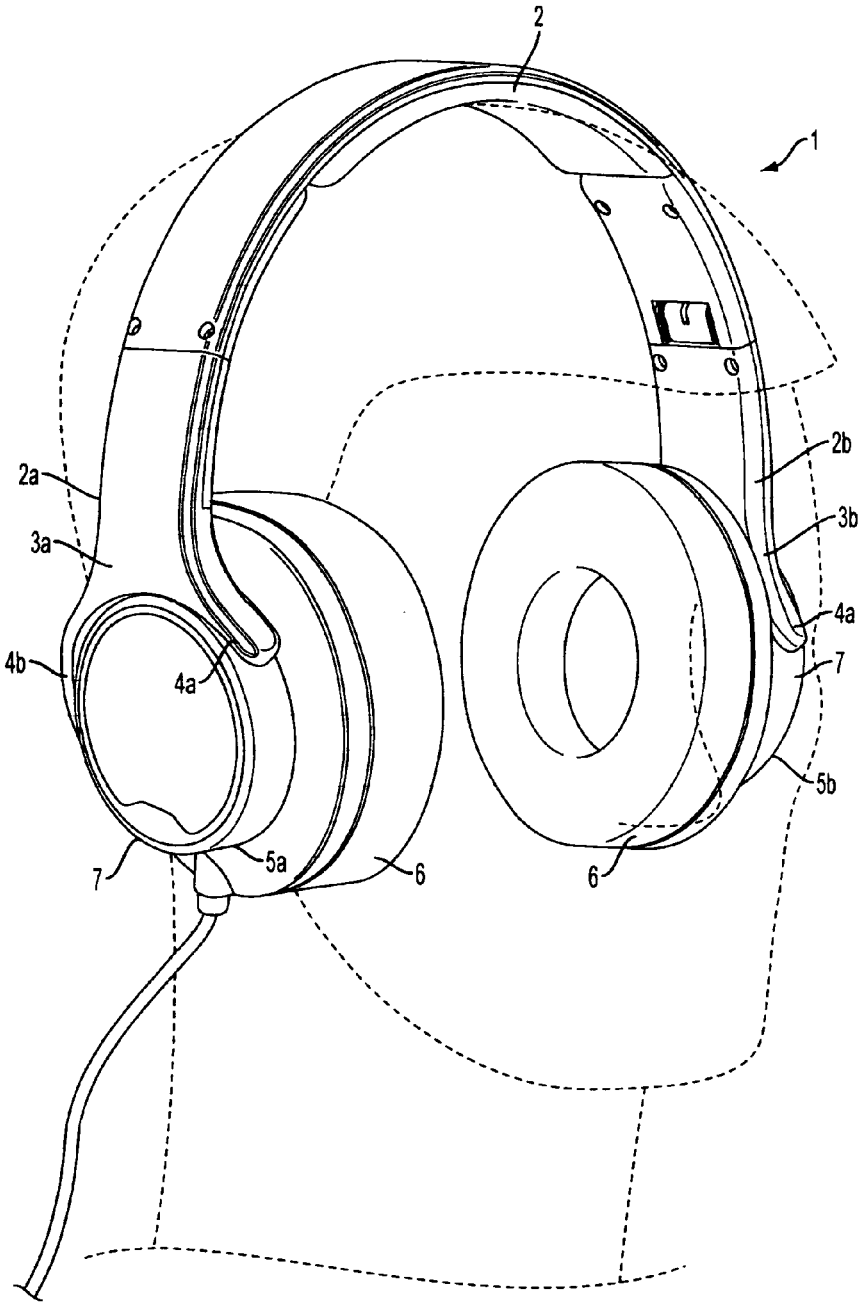
FIG. 5 is a perspective view of the apparatus of the present invention in a music listening mode on a user's head.

FIG. 5 illustrates the music listening and playing apparatus 1 of the present invention. The apparatus comprises a headband 2 having opposing ends, 2*a* and 2*b* respectively; at least two connectors, 3*a* and 3*b* respectively, each of the connectors has at least two arms, 4*a* and 4*b* respectively. The first arm 4*a* is shorter than a second arm 4*b*.

The apparatus 1 further comprises at least two speakers, 5*a* and 5*b* respectively, each of the speakers having opposing sides and comprising an audio output element 6 on a first side and a compartment 7 on a second side. The first and second arms, 4*a* and 4*b*, of each of the connectors is pivotally attached to a portion of each of the speakers, 5*a* or 5*b*, to thereby allow rotation of said speakers. Each of the audio output elements 6 of each of the speakers, 5*a* and 5*b*, generally face one another during a first music listening mode. In the music listening mode, the headband 2 is situated around the user's head and the audio output element 6 of each of the speakers, 5*a* and 5*b*, are generally facing the user's ears.

Figure 6:
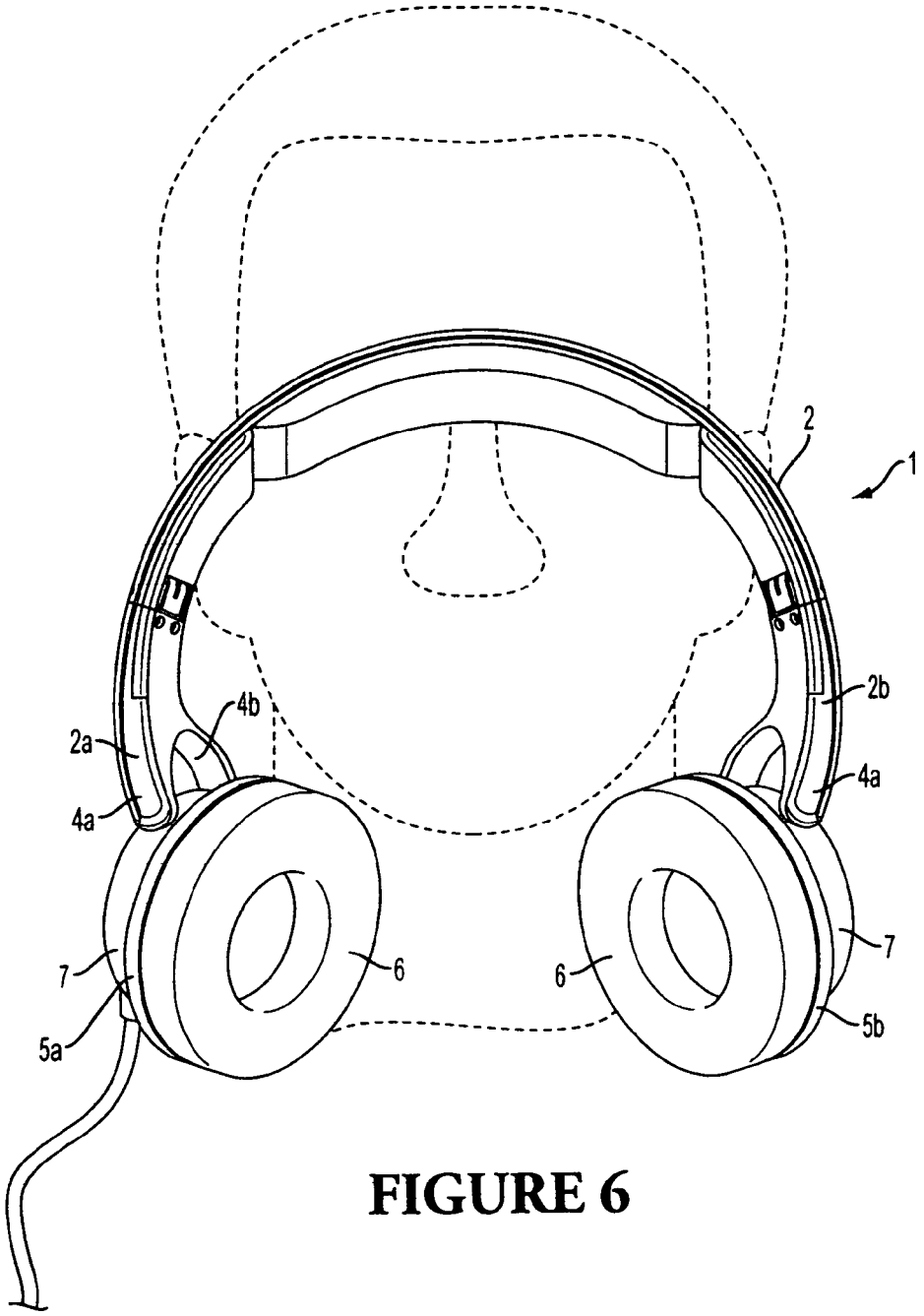
FIG. 6 is a perspective view of the apparatus of FIG. 5 in a music playing mode around a user's neck.

FIG. 6 depicts the second music playing mode of the apparatus 1 of the present invention. The apparatus 1 may be placed around the user's neck. Each of the speakers, 5*a* and 5*b*, are rotatable about the first and second arms, 4*a* and 4*b*, of each of the connectors, 3*a* and 3*b*, to thereby allow each of the audio output elements 6 of each of the speakers, 5*a* and 5*b*, to turn away from one another during the second music playing mode. The rotation of the speakers, 5*a* and 5*b*, allows for changes in modes.

Figure 7:
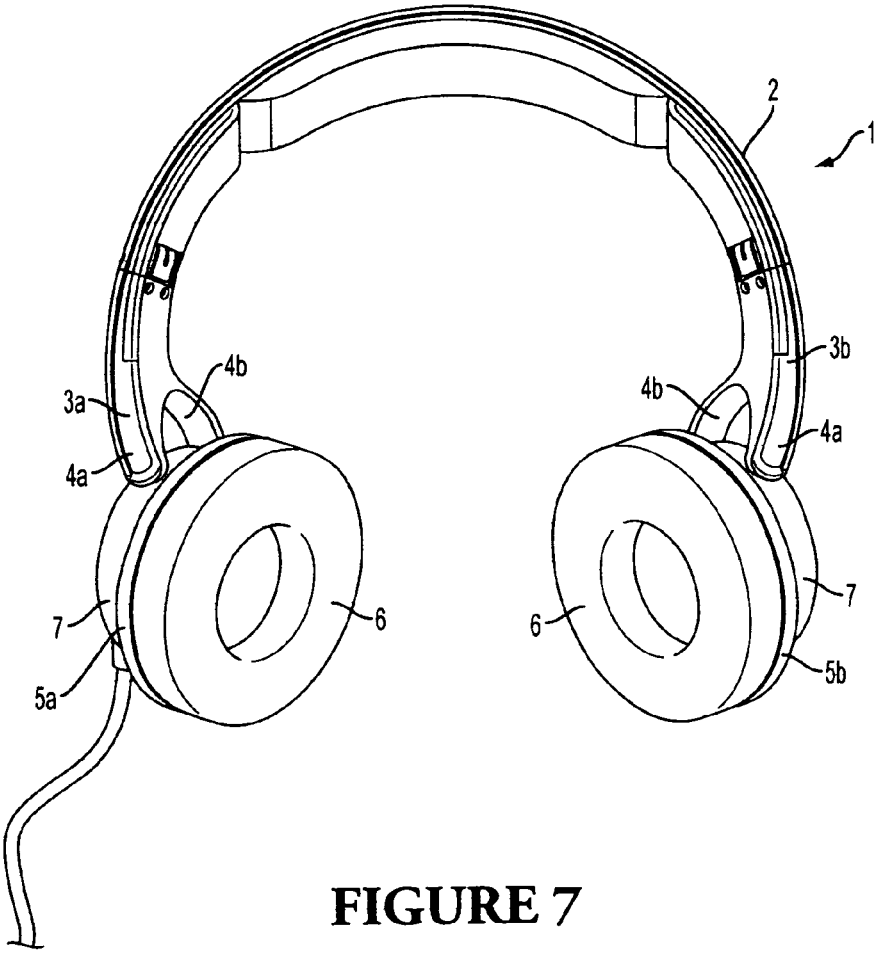
FIG. 7 is a perspective view of the apparatus of FIG. 5 in a music playing mode when the apparatus is place on a surface.

FIG. 7 shows another music playing mode where the apparatus 1 is set on a surface and the headband 2 is generally parallel to the surface 10 and the speakers, 5*a* and 5*b*, are designed to be rotated about the first and second arms, 4*a* and 4*b*, of each of the connectors, 3*a* and 3*b*, to allow the audio output elements 6 of each of the speakers, 5*a* and 5*b*, to generally face away from the surface 10 during the second music playing mode.

Figure 8A:
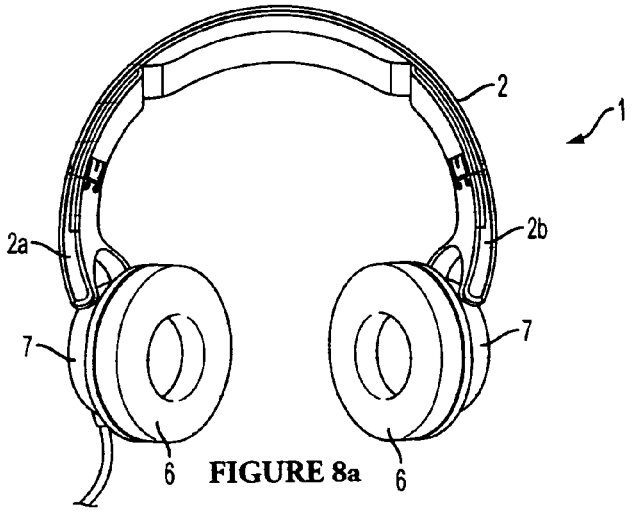
FIG. 8*a-c* are perspective side view of the apparatus showing the rotation of the speakers.
Figure 8B:
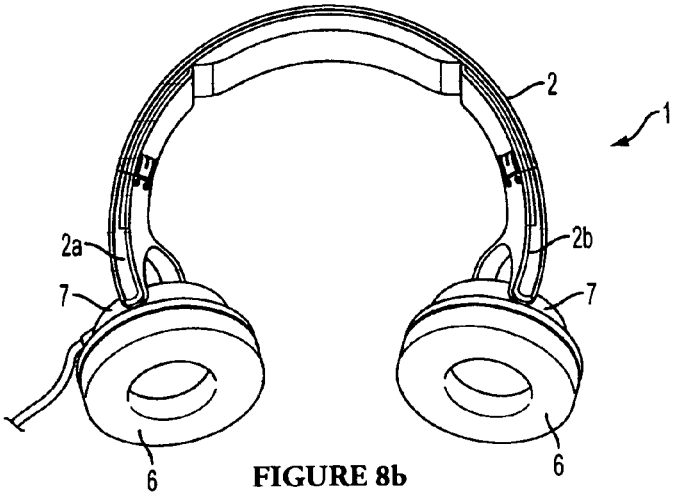
Figure 8C:
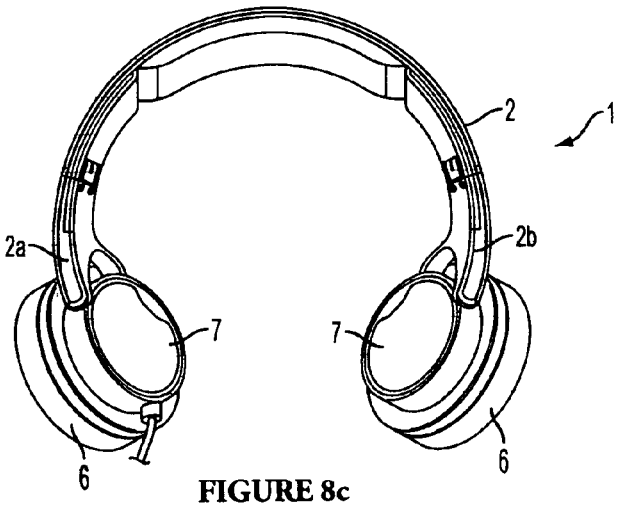

FIGS. 8*a-c* illustrates the rotation of the speaker, 5*a* and 5*b*. During the music listening mode, the audio output element 6 of the speaker 5*a* is generally facing inward as shown in FIG. 8*a*. The speaker 5*a* is rotated outwardly to activate the music playing mode as shown in FIG. 8*b*. In the music playing mode, the speaker 5*a* may be adjusted for optimum sound as shown in FIG. 8*c*. The speaker 5 may then be rotated back to its original position as shown in FIG. 8*a* to return to the music listening mode.

Each of the speakers, 5*a* and 5*b*, rotates about an axis 8 formed by the first and second arms, 4*a* and 4*b*, of each of the connectors, 3*a* and 3*b*. Each of the speakers, 5*a* and 5*b*, is designed to rotate about the axis 8 during the first music listening mode at angles from about 0 degrees to about 100 degrees as shown in FIG. 9*a*.

Figure 9B:
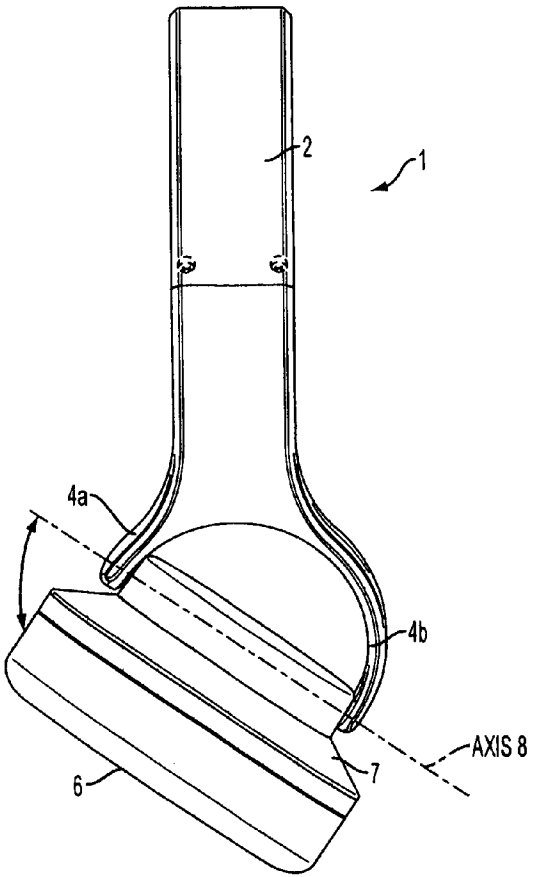
FIG. 9*a-b* are views of the apparatus showing the angles created by the rotation.
Figure 9A:
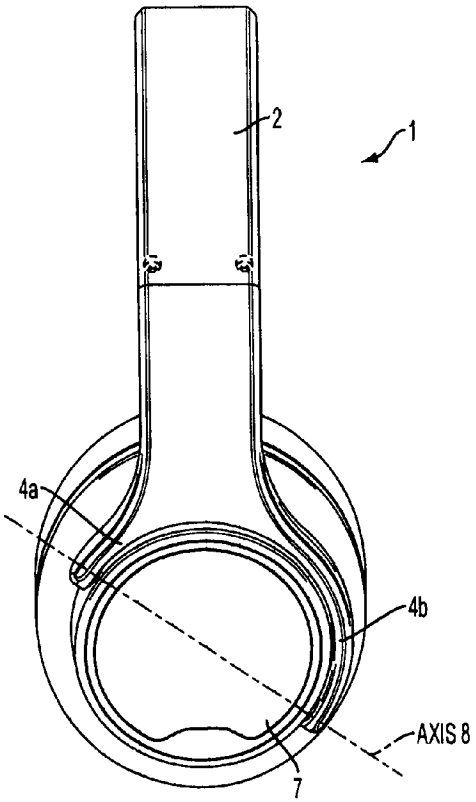

Each of the speakers, 5*a* and 5*b*, is designed to rotate about the axis 8 during the second music playing mode at angles from about 20 degrees to greater than 180 degrees as shown in FIG. 9*b*.

Figure 10:
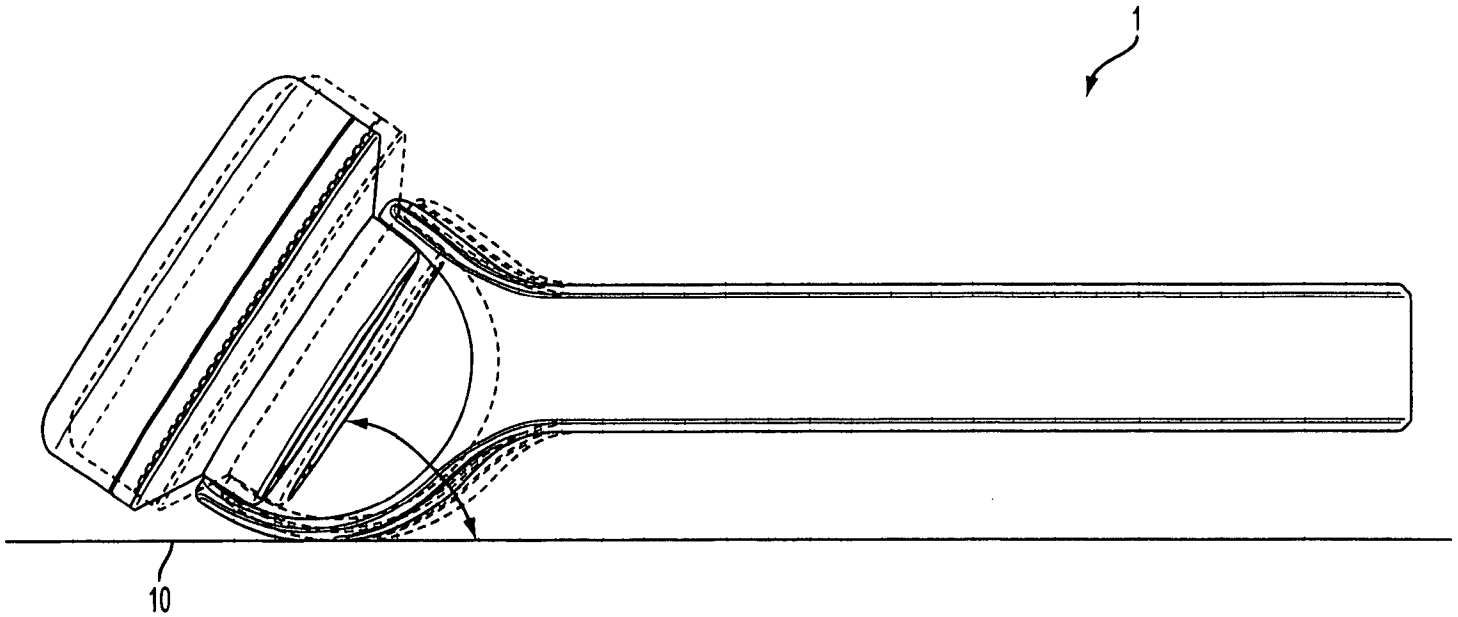
FIG. 10 is view of the apparatus in FIG. 7 showing how the differing length of the arms create angles between the speaker and the surface.

FIG. 10 shows that differing the length ratios of the arms, 4*a* and 4*b*, create different angles between the speaker 5*a* and surface 10. The length of the second arm 4*b* relative to the first arm 4*a* creates an angle between the surface 10 and at least one speaker 5, and the angle is greater than 1 degree and less than 90 degrees.

Figure 11A:
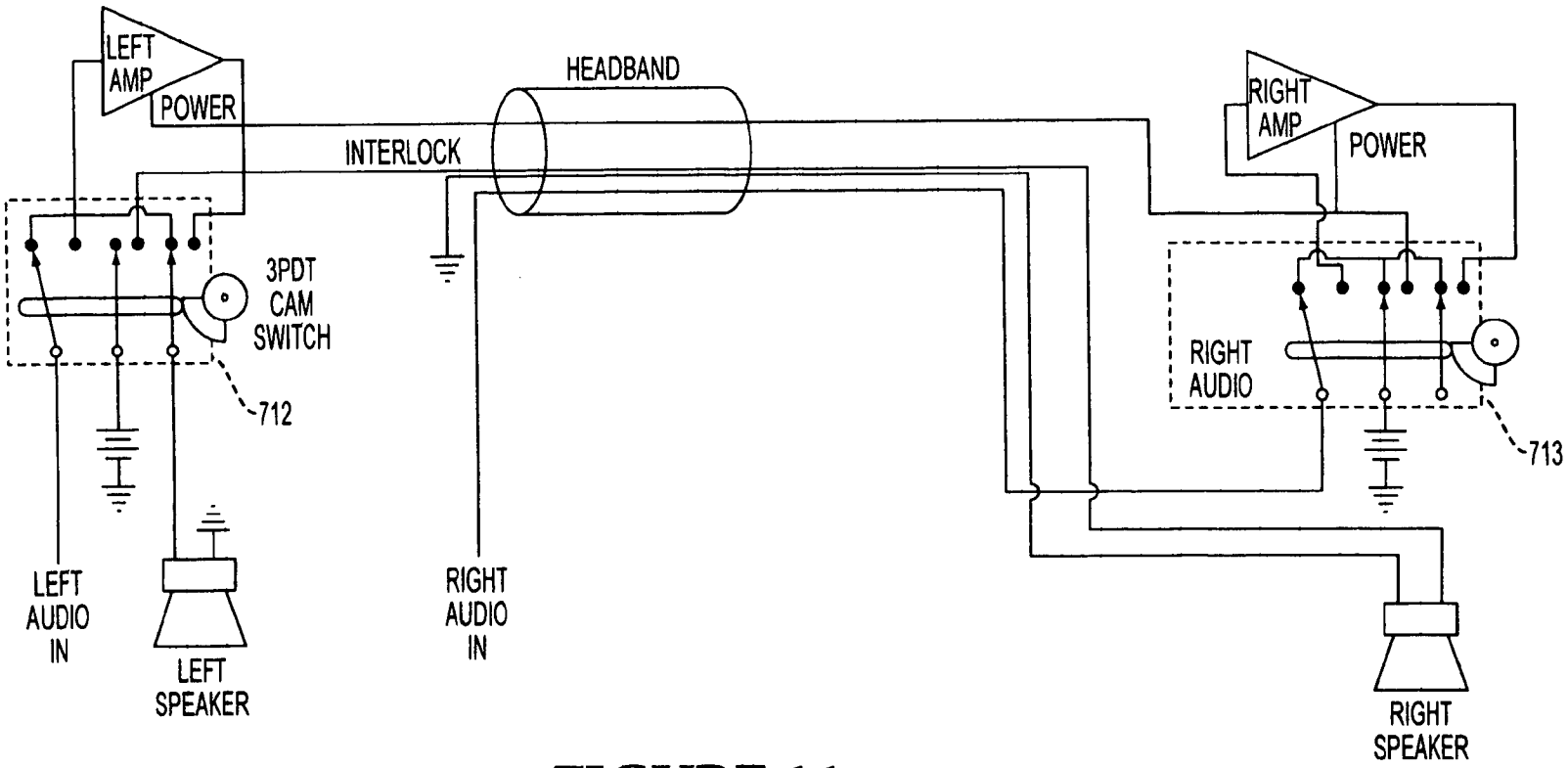
FIG. 11*a-b* are schematic view of one of the embodiments of the switch mechanism.
Figure 11B:
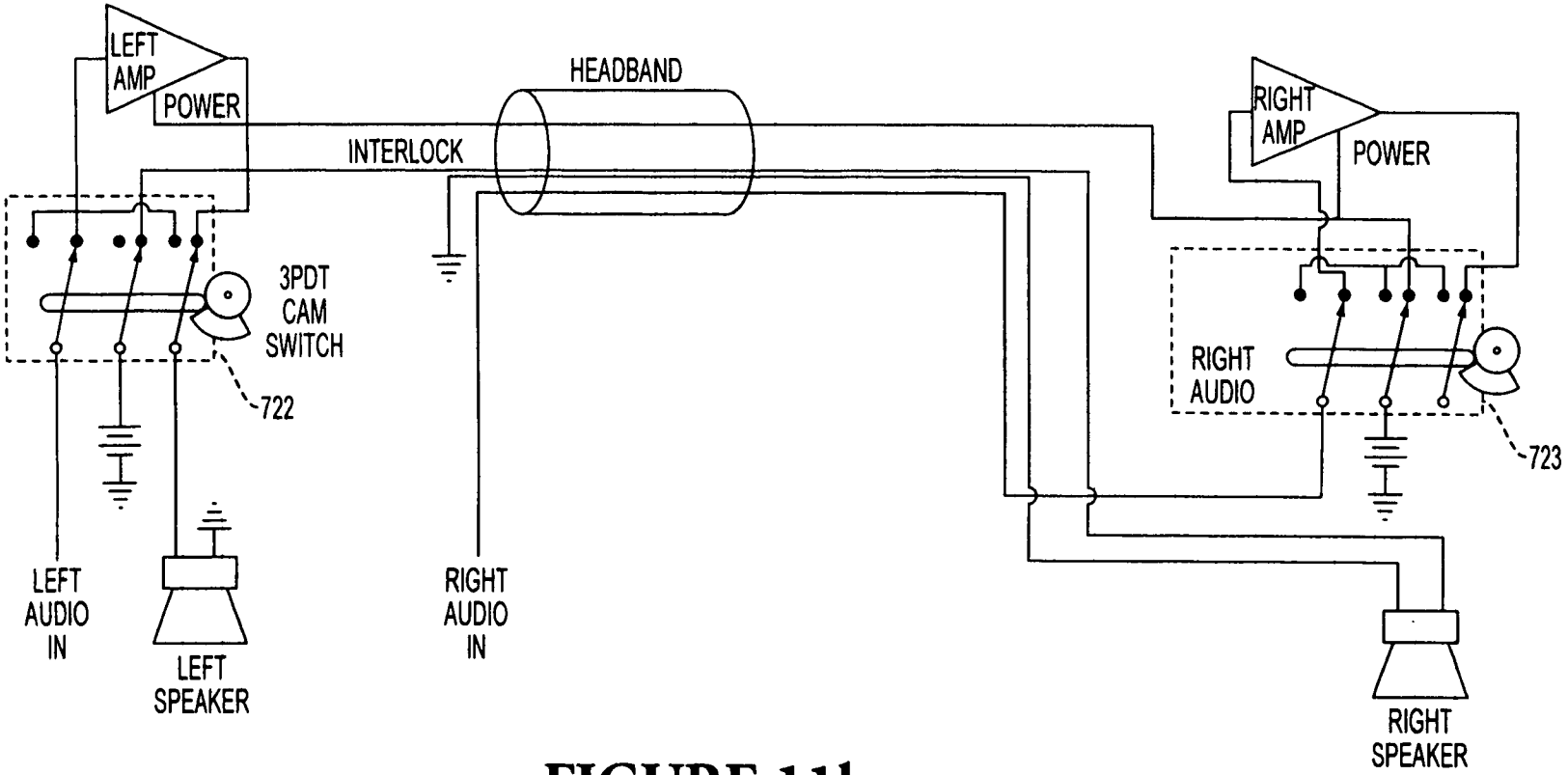

FIGS. 11*a-b* are schematic diagrams of one of the embodiments of the circuitry of the present invention. In this embodiment, the cam switch 712 (shown schematically) has three contacts on the input, and six on the output (a three pole double throw switch—3PDT).

When the axle is not rotated and the product is worn as a headphone, the switch connects the left audio channel directly to the left speaker, and the right audio channel to the right speaker, and does not route power to the amplifier. The music device powers the acoustic transducer directly. However, once the enclosures are rotated by more than 30 degrees, the two 3PDT switches 722 and 723 are thrown closed. This now routes the left audio signal to the left amplifier and the output of the left amplifier to the left speaker (and similarly for the right channel). It also provides power to the amplifier by running the power through the right enclosure switch in series—thus assuring both switches must be closed (and thus the speakers aimed safely away from the ears) before energizing the amplifier.

What is claimed is:

1. A music playing and listening apparatus comprising:

a headband having opposing ends, said headband having at least one hinge;

at least two connectors, each of said connectors having at least two arms, a first arm being shorter than a second arm, said first and said second arm form an axis;

at least two speakers, each of said speakers having opposing sides and comprising an audio output element on a first side and a compartment on a second side, said first and second arms of each of said connectors being pivotally attached to a portion of each of said speakers to thereby allow rotation of said speakers about said axis, each of said audio output elements of each of said speakers generally face one another during a first music listening mode, each of said speakers being rotatable about said first and second arms of each of said connectors to thereby allow each of said audio output elements of each of said speakers to turn away from one another during a second music playing mode; the rotation of said speakers allowing for changes in modes, said hinge of said headband allows said headband to open a wider distance between said speakers in said second music playing mode;

at least one amplifier, said amplifier is connected to a portion of at least one of said speakers; and at least one switching mechanism, said switching mechanism is activated by rotating each of said speakers from said music listening mode to said second music playing mode, said rotation of said speakers activates said amplifier.

2. The apparatus of claim 1 wherein said hinge is centrally located on said headband.

3. The apparatus of claim 1, wherein there are two hinges on said headband equally spaced apart from said opposing ends of said headband.

4. The apparatus of claim 1 wherein said axis of rotation has an angle from about 30 degrees to about 60 degrees relative to a plane of said headphone.

5. The apparatus of claim 4 wherein each of said speakers is designed to rotate about said axis during said first music listening mode at angles from about 0 degrees to about 180 degrees.

6. The apparatus of claim 1 wherein said headband is generally situated over a user's head and each of said audio output elements of each of said speakers generally faces the user's ears during said first music listening mode.

7. The apparatus of claim 1 wherein said apparatus is set on a surface and said speakers are designed to be rotated about said first and second arms of each of said connectors to allow said audio output elements of each of said speaker to generally face away from the surface during said second music playing mode.

8. The apparatus of claim 1 further comprising a safety interlocking device which is designed to limit the volume output of said speakers in said first listening mode and increases the volume output of said speakers during said second music playing mode.

9. The apparatus of claim 1 wherein at least one of said compartments of said speakers provides for storage of a power source.

10. The apparatus of claim 1 further comprises at least one power source, said power source is a battery.

11. The apparatus of claim 1 further comprises an on and off mechanism.

12. The apparatus of claim 1 further comprising volume control mechanism, said volume control mechanism controls audio output volume of said speakers.

13. The apparatus of claim 1 further comprising a cable.

14. The apparatus of claim 1 further comprising a wireless receiver designed to accept audio signals from an external source.

15. A music playing and listening apparatus comprising:

a headband having opposing ends, said headband having at least one hinge;

at least two connectors, each of said connectors having at least two arms, a first arm being shorter than a second arm, said first and said second arm form an axis;

at least two speakers, each of said speakers having opposing sides and comprising an audio output element on a first side and a compartment on a second side, said first and second arms of each of said connectors being pivotally attached to a portion of each of said speakers to thereby allow rotation of said speakers about said axis, each of said audio output elements of each of said speakers generally face one another during a first music listening mode, each of said speakers being rotatable about said first and second arms of each of said connectors to thereby allow each of said audio output elements of each of said speakers to turn away from one another during a second music playing mode; the rotation of said speakers allowing for changes in modes, said hinge of said headband allows said headband to open a wider distance between said speakers in said second music playing mode;

at least one amplifier, said amplifier is connected to a portion of at least one of said speakers; and at least one switching mechanism, said switching mechanism is activated by rotating one of said speakers from said music playing mode to said second music listening mode, said rotation of one of said speakers deactivates said amplifier.

16. The apparatus of claim 15 wherein said axis of rotation has an angle from about 30 degrees to about 60 degrees relative to a plane of said headphone.

17. The apparatus of claim 16 wherein each of said speakers is designed to rotate about said axis during said first music listening mode at angles from about 0 degrees to about 180 degrees.

18. The apparatus of claim 15 wherein said headband is generally situated over a user's head and each of said audio output elements of each of said speakers generally faces the user's ears during said first music listening mode.

19. The apparatus of claim 15 wherein said apparatus is set on a surface and said speakers are designed to be rotated about said first and second arms of each of said connectors to allow said audio output elements of each of said speaker to generally face away from the surface during said second music playing mode.

* * * * *